US005351583A

United States Patent [19]

Szymber et al.

[11] Patent Number: 5,351,583

[45] Date of Patent: * Oct. 4, 1994

[54] TOOTHLESS RATCHET, CLUTCH, AND MECHANISMS TO ELIMINATE BACKLASH

[75] Inventors: Oleg Szymber, Arlington Heights, Ill.; Eustathios Vassiliou, Newark, Del.

[73] Assignee: PatCore, Incorporated, Newark, Del.

[ * ] Notice: The portion of the term of this patent subsequent to Oct. 6, 2009 has been disclaimed.

[21] Appl. No.: 25,573

[22] Filed: Mar. 3, 1993

[51] Int. Cl.[5] ..... B25B 13/46

[52] U.S. Cl. ..... 81/60; 81/59.1; 192/44

[58] Field of Search ..... 81/58.3, 60, 63.1; 192/66, 70.3, 93 A, 108

[56] References Cited

U.S. PATENT DOCUMENTS

| | | | |
|---|---|---|---|
| 2,609,718 | 9/1952 | Fluke | 81/58.3 |
| 4,441,387 | 4/1984 | Hendricks | 81/61 |
| 4,524,652 | 6/1985 | Wenzel et al. | 81/63 |
| 5,052,252 | 10/1991 | Szymber et al. | 81/416 |
| 5,152,197 | 10/1992 | Szymber et al. | 81/59.1 |

*Primary Examiner*—James G. Smith
*Attorney, Agent, or Firm*—E. Vassiliou

[57] ABSTRACT

A toothless ratchet and clutch mechanisms chararacterized by substantially continuous engagement of the rachet wheel, thus allowing the mechanism to operate even under very limited-space conditions. Also, a biasing mechanism for the stem of the socket driver of the rachet or clutch, which eliminates backlash, if the stem is undersized as compared to the socket cavity which receives the stem.

16 Claims, 11 Drawing Sheets

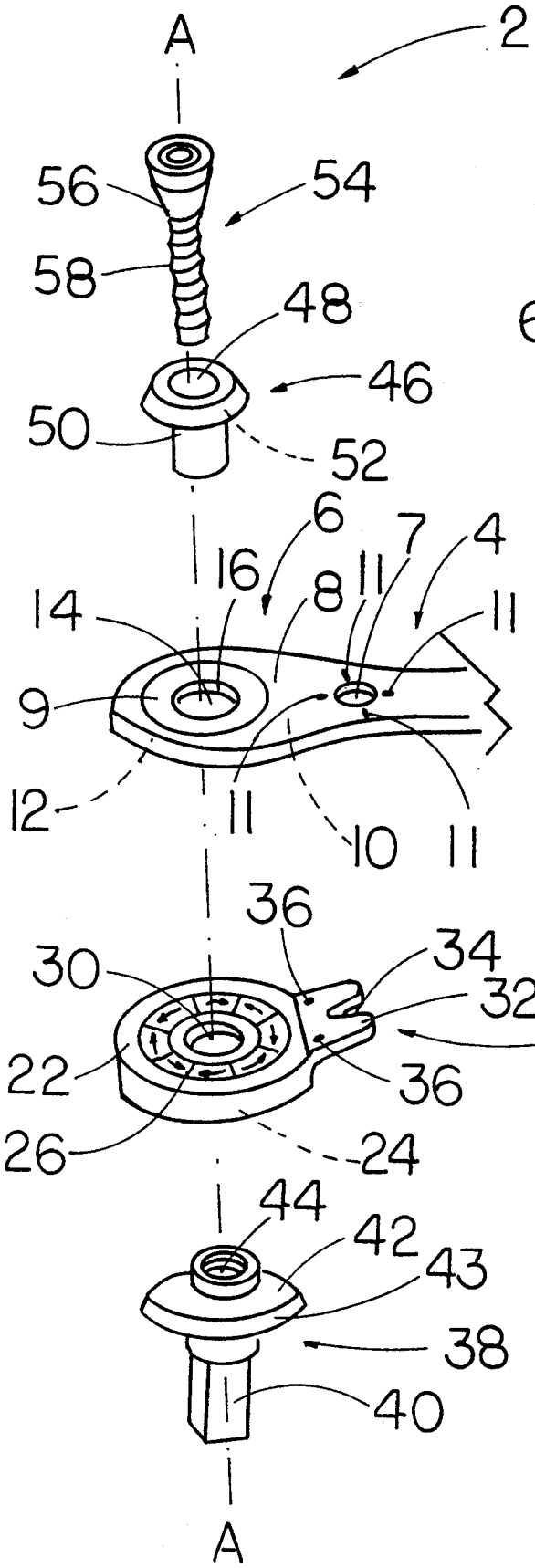
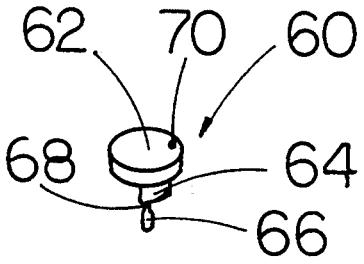
FIG. 1b
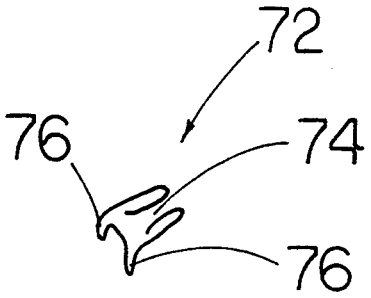
FIG. 1c
FIG 1a

FIG. 6iii

TOOTHLESS RATCHET, CLUTCH, AND MECHANISMS TO ELIMINATE BACKLASH

FIELD OF THE INVENTION

This invention relates to ratchets and clutch mechanisms, and more particularly to a toothless ratchet.

BACKGROUND OF THE INVENTION

Ratchet mechanisms typically involve wheels or bars having inclined teeth, in which a pawl drops so that motion can be imparted to the wheel or bar, governed, or prevented. Rachet mechanisms are usually employed in hand tools of different kinds, such as wrenches, screwdrivers, and the like, in order to allow effective motion in one direction and prevent motion in the opposite direction.

Examples of tools using rachet mechanisms are given by U.S. Pat. Nos. 4,441,387 (Hendricks), and 4,524,652 (Wenzel et al.), among many others.

A large number of greatly diversified applications utilize also ratchet mechanisms in cases where effective unidirectional motion is needed. These applications may include drastically different end-uses, such as for example sailing winches, dental floss disposers, seat belt retractors, security entry systems, spinning reels, control manifolds, reclining mechanisms, labelers, mop connectors, faucet valves, exercise devices, printing apparatuses, cable hoists, and kite reels, to mention a few.

One of the biggest disadvantages of conventional ratchet mechanisms is that for the pawl to move from one tooth and engage the next tooth, the handle has to turn by an angle of typically 15–20 degrees. In addition, since the teeth are inclined, the backward motion required to engage a tooth starting from the preceding tooth is larger than the effective forward motion to turn the ratchet wheel, and thus additional "dead" space is needed. If there is no adequate space for such a manipulation the operation of using the ratchet cannot be performed. With the continuing trend to produce more and more compact cars, the open space under the hood of modern cars is becoming increasingly limited, and thus effective tools capable of operating in limited space are very desirable and many times absolutely necessary.

U.S. Pat. No. 5,152,197 (Szymber et al.), which is incorporated herein by reference, describes a mechanism characterized by substantially continuous engagement of the ratchet wheel. This mechanism provides substantially immediate engagement, but it requires rather accurate tooling for its production, especially for the formation of the augmented semi-cells.

U.S. Pat. No. 5,052,252 (Szymber et al.) which is incorporated herein by reference, shows a locking mechanism for pliers. In certain embodiments, shown in FIGS. 13 and 14, there are described mechanisms, of locking the pliers by the use of matching conical frictional surfaces.

None of the above references discloses, suggests or implies the use of a mechanism comprising the elements of the present invention, as described in detail hereinafter. In addition, a vital problem that none or the above references addresses is the slack between the stem of the rachet driver and the socket which mounts on said driver. This additional problem is solved in preferred embodiments of the present invention.

SUMMARY OF THE INVENTION

The present invention pertains to a toothless ratchet tool, or a stepless socket driver comprising in combination an assembly of:

a handle ending to a head, the head having an upper side and a lower side opposite the upper side, the lower side comprising a first set of helical doublets of ramps, each doublet of ramps comprising two single ramps of opposite helical inclination, the doublets of ramps disposed around a center axis, the center axis passing through a central point of the head, and being perpendicular to the lower and upper sides;

an activator disposed toward the lower side of the head and pivoted around the center axis, the activator having a doublet side and a first frictional side opposite the doublet side, the first frictional side comprising at least one first frictional surface the doublet side comprising a second set of helical doublets of ramps commensurate to the first set of the helical doublets of ramps of the lower side of the head, thus forming pairs of co-acting doublets of ramps;

a driver being turnable around the center axis and disposed under the activator in a manner to place the activator between the driver and the head of the handle, the driver having a socket driving side and a second frictional side commensurate to and adaptable to engage with the first frictional side through through at least one second frictional surface; and means for rotatably connecting the driver and the head of the handle, and at such distance from each other, that when the doublets of helical ramps of each pair are caused to be displaced with respect to each other, the activator is pushed toward the driver causing the first and the second frictional surfaces to firmly engage and lock the driver in one direction with respect to the handle.

The instant invention, also pertains to a clutch mechanism comprising in combination an assembly of:

a base having a head, the head having an upper side and a lower side opposite the upper side, the lower side comprising a first set of helical doublets of ramps, each doublet of ramps comprising two single ramps of opposite helical inclination, the doublets of ramps disposed around a center axis, the center axis passing through a central point of the head, and being perpendicular to the lower and upper sides;

an activator disposed toward the lower side of the head and pivoted around the center axis, the activator having a doublet side and a first frictional side opposite the doublet side, the first frictional side comprising at least one first frictional surface;

the doublet side comprising a second set of helical doublets of ramps commensurate to the first set of the helical doublets of ramps of the lower side of the head, thus forming pairs of co-acting doublets of ramps;

a driver being turnable around the center axis and disposed under the activator in a manner to place the activator between the driver and the head of the handle, the driver having a socket driving side and a second frictional side commensurate to and adaptable to engage with the first frictional side through at least one second frictional surface; and means for rotatably connecting the driver and the head of the handle, and at such distance from each other, that when the doublets of helical ramps of each pair are caused to be displaced with respect to each other, the activator is pushed toward the driver causing the first and the second frictional surfaces to firmly engage and lock the driver in one direction with respect to the base.

The rachet tool or the clutch mechanism may further comprise first biasing means for biasing the doublets of helical ramps of each pair in a position causing the mechanism to follow a condition selected from the group consisting of locking the head or base with respect to the driver in one direction, locking the head or base with respect to the driver in an opposite direction, locking the head or base with respect to the driver in both directions, maintaining the head or base unlocked with respect to the driver in both directions, and a combination thereof.

The present invention is also directed to a rachet tool comprising in combination an assembly of:

a head and a socket driver;

means for engaging the head with the socket driver in a mode, wherein the driver is engaged with and follows the head when the head is turned in one direction, while the driver is disengaged from the head when the head is turned in the opposite direction; and a stem extending from the driver, and adapted to fit in a multi-sided cavity of a socket in order to drive the socket, the stem comprising second biasing means for positioning the stem with respect to the socket in such a manner as to eliminate backlash of the head, if the stem is undersized as compared to the size of the multi-sided cavity of the socket.

Preferably, one or any compatible combination of the following conditions may be utilized in the practice of this invention, in conjunction with one or more of the above requirements:

the doublets of helical ramps are equidistantly disposed from the center axis and also equidistantly disposed from each other;

the first frictional surface comprises a configuration corresponding to at least part of the inside surface of a cone, and the second frictional side comprises a configuration corresponding to at least part of the outside surface of a cone;

the first frictional surface and the second frictional surface exhibit a cone angle in the range of 10–40 degrees;

the helical angle of the ramps has a value of 10–25 degrees;

the clutch mechanism comprises pulsating means pivotally connected to the base for providing oscillatory motion to the base, the oscillatory motion characterized by an oscillation angle having an effective value to translate the oscillatory motion of the base to rotational motion on the driver;

the ratchet tool and/or the clutch mechanism comprise a socket supported on the base, the socket having a cavity of the type which can accept and engage with a socket driving stem, or with another element which may be driven, such as a nut for example;

the stem comprises a second biasing means for biasing the position of the stem with respect to the socket in such a manner as to eliminate backlash of the base, regardless of the direction in which the head is locked with respect to the driver, if the stem is undersized as compared to the size of the multi-sided cavity of the socket;

the second bias means comprises a spring frictionally engaged to the stem, wherein the spring may have a substantially round shape and two open ends, both ends are adaptable to coact with one side of the multi-sided cavity of the socket; or have two open ends, each end being adaptable to coact with a different side of the multi-sided cavity of the socket.

In a preferred embodiment, the stem comprises means to secure a socket on said stem, and second bias means comprising a spring connected to the stem and adaptable to frictionally engage to the socket.

BRIEF DESCRIPTION OF THE DRAWING

The present invention will be best understood from the following description taken together with the accompanying drawing in which:

FIGS. 1*a*, 1*b*, and 1*c* illustrate a perspective view of the parts of a disassembled ratchet tool according to a preferred embodiment of this invention.

FIG. 6*ii* illustrates the bottom view of the activator depicted in FIG. 6*i*.

FIG. 6*iii* is a fragmental cross-sectional view of one pair of the plurality of frictional surfaces of FIG. 6*i*.

DETAILED DESCRIPTION OF THE INVENTION

Figures 2A, 2B, 2C, 2D:
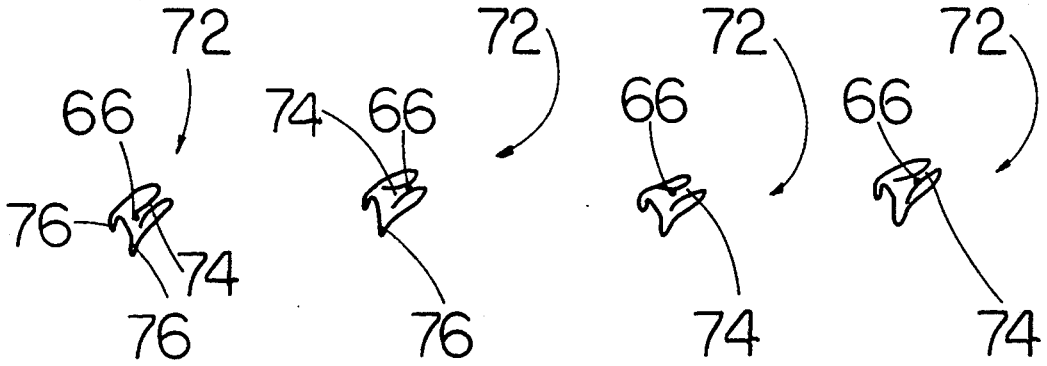
FIGS. 2*a*, 2*b*, 2*c*, and 2*d* show different biasing conditions of the first biasing means generated by the thin stalk.

In a preferred embodiment of this invention, the clutch mechanism is in the form of a toothless ratchet tool, or a stepless socket driver.

Referring now to FIGS. 1–5, there is depicted a toothless ratchet tool or a stepless socket driver 2 comprising in combination an assembly of elements as indicated below. The major part of the tool 2 may be preferably made of metal, more preferably steel, and even more preferably hardened steel. However, any other materials of construction, such as for example plastics, reinforced plastics, and the like, are not excluded, and depending on the application they may be used exclusively or in combination with other fabrication materials. Any method of fabrication may be used, such as for example machining, forging, powder sintering and metallurgy, casting, molding, and the like, depending on the fabrication characteristics of the materials used, the accuracy required, the expense permitted for the particular application, and the like, as well as combinations thereof.

The tool 2 comprises a handle 4, which ends to a head 6. The handle 4 may have any type of cross section which is suitable for a handle, such as for example square, round, polygonal, and the like, as well as combinations thereof. Certain portions of the handle may be knurled for better grasp of the tool. The head 6 has an upper side 8 and a lower side 10, opposite the upper side 8. Preferably, the sides 8 and 10 are substantially parallel to each other and in general flat, except for certain cavities they may possess. The head 6 has also a perforation 7 and indentations 11 near the border where it extends to the rest of the handle 4.

The upper side 8 preferably comprises a first circular bearing surface 9, which is symmetrically disposed around a center axis A—A'.

The lower side 10 comprises a first set 12 of helical doublets of ramps, each doublet of ramps comprising two single ramps 12" and 12' of opposite helical inclination. These ramps are substantially mirror images of respective ramps on an activator 20, as explained hereinbelow.

The ramps 12' and 12" are disposed around the center axis A—A', which axis preferably coincides with the axis of the helices corresponding to the ramps, passes through a central point 14 of the head 6, and is substantially perpendicular to the upper side 8 and lower side 10. Preferably, the single ramps 12 and 12' are equidistantly disposed from the center axis A—A', and also equidistantly disposed from each other. Since it is preferable for the doublets of ramps to be equidistant from the axis A—A', they are located along the circumference of a circle. As aforementioned, it is preferable that the doublets of ramps are arranged on the circumference of a circle. Depending on the intended use of the tool, more than one circles with doublets of ramps, or randomly arranged doublets may constitute the first set.

Preferably, the head 6 has also a first center bore 16, which is preferably circular and has as center the central point 14.

Figure 4:
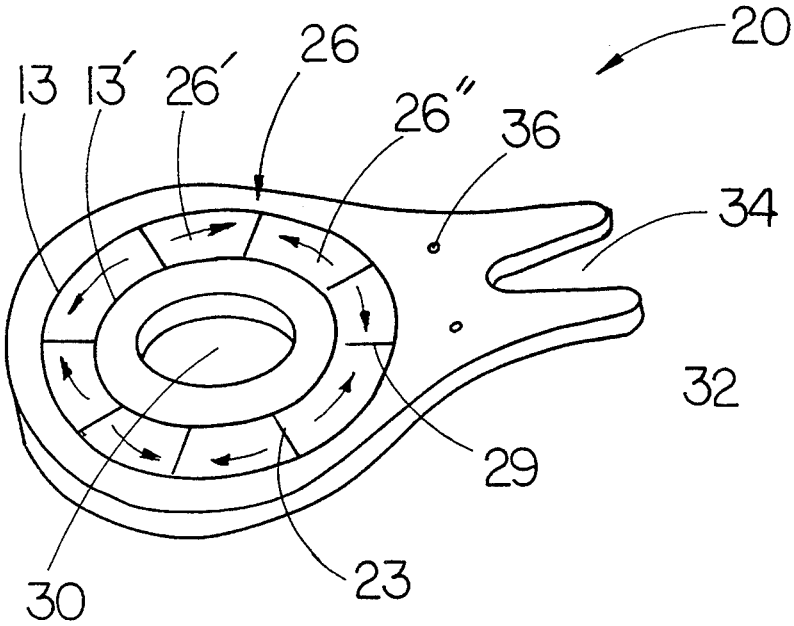
FIG. 4 shows a more detailed perspective view of the activator used in the embodiment of FIG. 1*a*.

The tool also comprises an activator 20, which is disposed toward the lower side 10 of the head 6. The activator 20 is pivoted around the center axis A—A'. It has a doublet side 22 and a first frictional side 24 opposite the doublet side 22. The doublet side 22 comprises a second set of doublets of ramps 26 (as indicated in FIG. 4) commensurate to the first set of doublets of ramps 12 of the lower side 10 of the head 6, thus forming pairs of doublets of ramps. The single ramps of opposite inclination to each other 26' and 26" are substantially mirror images of single ramps 12' and 12", respectively. In this respect, the second set of doublets of ramps 26 is substantially a mirror image of the first set of doublets of ramps 12. Each ramp and its mirror-image ramp may be visualized as fragments of the thread of a screw and the respective thread of a nut, in a preferred configuration of this invention. As aforementioned, the doublets of helical ramps are preferably disposed on the circumference of a circle having a center on the center axis A—A'. Unfolding this circumference into a linear configuration gives a better image of the structure of the pairs of doublets of ramps, as better shown in FIG. 5. Thus, the word "unfolded" signifies that a curved section, such as a circular section for example, has been unfolded into a linear two dimensional view for better understanding.

Referring back to FIG. 4, the direction of the arrows signifies rise of level within the simple helical ramps 26' and 26". Angle of a helix or angle of inclination of a helix is defined as an angle, the tangent of which equals the axial displacement (displacement parallel to the axis) of a point on the helix after it moves a full turn (360 degrees) on the helix, divided by the circumferential distance that said point has travelled in one full turn. Since, each helical ramp has an outer helical ramp side 13 and an inner helical ramp side 13', angle of the helical ramp is defined as the mean value of the angles of the helices corresponding to the two helical ramp sides 13 and 13', for the purposes of this invention. Preferably, the helices corresponding to the two sides 13, and 13' have a common axis, the axis A—A', better shown in FIG. 3.

Conventionally, a helix is formed when a point on the surface of a cylinder rotates around the axis of the cylinder and at the same time it is displaced in a direction parallel to the axis of the cylinder, in a manner that the displacement is proportional to the angle of rotation. However, for the purposes of this invention, the definition of a helix includes not only the conventional helix, but also any other similar ascending or descending configuration which allows the the ramps of the first set 12 to slide on respective ramps of the second set 26. It is important that the sets of ramps are made such that as high as possible surface area of one ramp is in contact with as much as possible surface area of the respective ramp during the sliding process, in order to avoid wear and promote smooth operation of the mechanism. A person of ordinary skill in the art is able to select the appropriate parameters (rise of the two helices corresponding to sides 13 and 13' vs rotational angle around the common axis, and the like) in order to achieve such a condition. For the same reasons, lubrication of the ramps is also important.

Figure 3:
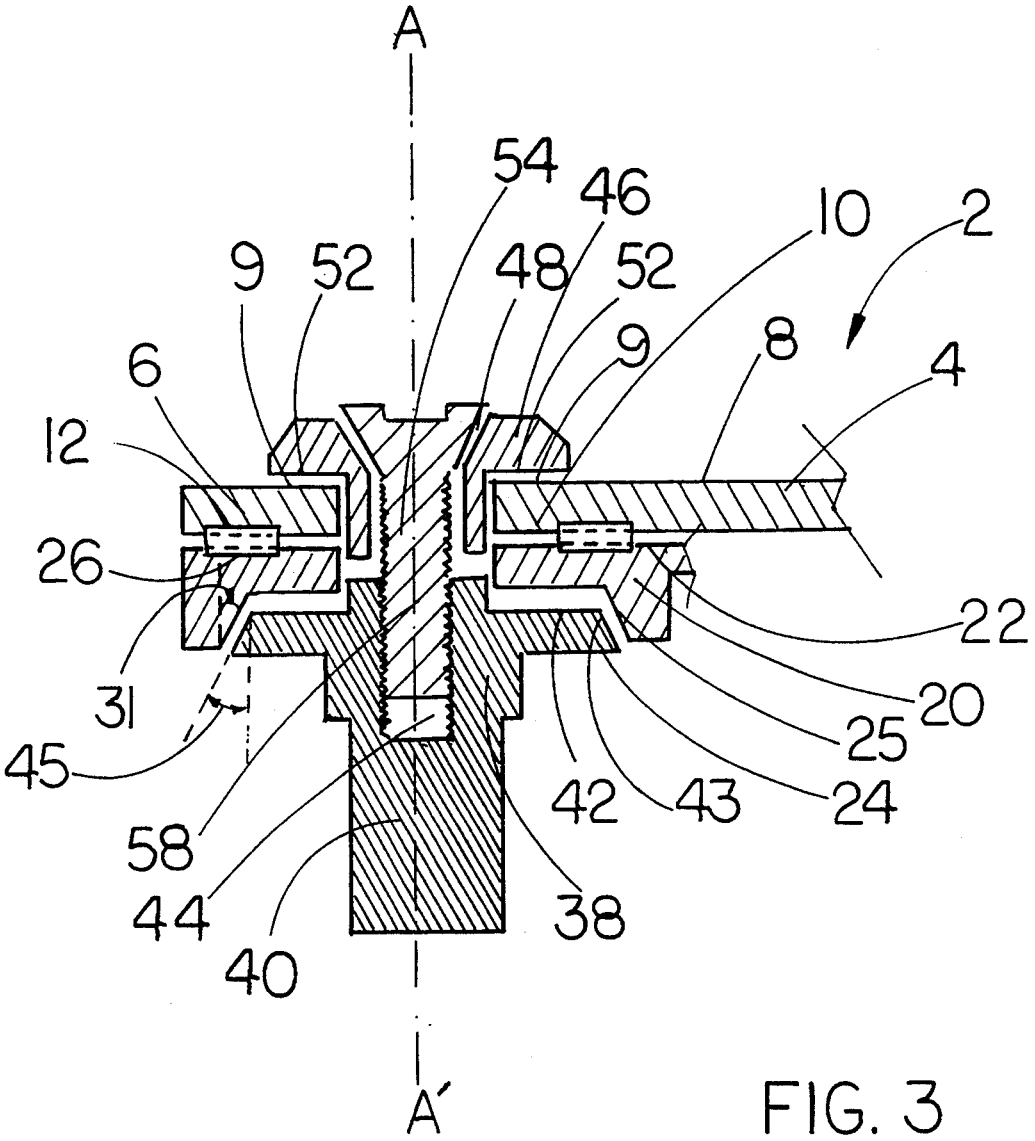
FIG. 3 is a fragmental schematic representation of a cross section of the assembled ratchet shown in parts in FIGS. 1*a* to 1*c*, except that the selector part is not shown for simplicity purposes.
Figure 5:
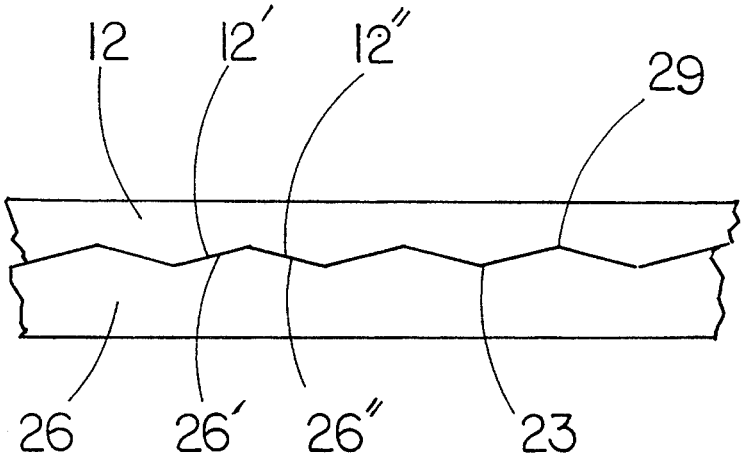
FIG. 5 illustrates an unfolded cross section of a pair of sets of doublets of ramps, which may be used for the locking mechanism of this invention.

In this particular example, there are four doublets per doublet set 12 and 26, as better shown in FIGS. 1*a*, 3, and 4. The activator 20 has a second center bore 30. Preferably, the axis A—A' passes also through the center of the second bore 30. The activator has also a guide 32 with an elongated slot 34, and two small holes 36.

The first frictional side 24 of the activator 20 contains a first frictional surface 25, and it characterized by a first cone angle 31, preferably between 10 and 40 degrees, and more preferably between 5 and 25 degrees. The first frictional side 24 is preferably in the form of a cavity corresponding to the inside surface of a cone, usually to the inside surface of part of a cone, as better shown in FIG. 3.

The tool 2, further comprises a driver 38, which is turnable around the center axis A—A' and is disposed under the activator 20, in a manner to place the activator 20 between the driver 38 and the head 6 of the handle 4. The driver 38 has a socket driving stem 40, and a second frictional side 42 comprising a second frictional surface 43. The second frictional side is commensurate to and adaptable to engage with the first frictional side 24 through the first and the second frictional surfaces 25 and 43, respectively. The second side has a second cone angle 45, which is substantially the same as the first cone angle. The second frictional side 42 preferably has the configuration of the outside surface of a cone, usually the outside surface of part of a cone. More than one pair of such frictional surfaces, preferably concentric, may be present. In the middle of the second frictional side 42, there is a threaded bore 44, as an integral part of the driver 38.

In this embodiment, the tool 2 also utilizes a restrictor 46, which has a V-shaped, third bore 48 and a sleeve 50. The axis A—A' passes also through the center of the third bore 48, and it is an axis of symmetry to the sleeve 50. The restrictor has a second circular bearing surface 52 commensurate to the first circular bearing surface 9, preferably flat. The second circular bearing surface 52 is concentric with the V-shaped bore 48 and the sleeve 50. Of course, it is desirable to use different mechanisms (not shown) to lock the bolt 54 on the driver 38. Such locking mechanisms include, but are not limited to interference threads, adhesion compounds (such as Loctite, for example, made by Loctite Corporation, Newington, Conn.), a set screw or pin, and the like, very well known to the art.

In addition, the tool 2 utilizes a bolt 54 having a V-shaped head 56, commensurate to the V-shaped bore 48. The bolt 54 has also a threaded body 58 commensurate to the threaded bore 44 of the driver 38. Of course instead of using a bolt, other arrangements may be made, such as for example using a relatively long stem (not shown) in place of the threaded bore 44 on the driver 38, which long stem after passing through bores 30, 16 and 48 may be swaged or riveted on top of the restrictor 46.

As it will better be seen later, the bolt 54 along with the restrictor 46 and the bearing produced between surfaces 9 and 52 may be considered as an extension of the driver 38, and constitutes means for rotatably connecting the driver 38 and the head 6 of the handle 4. By "rotatably connecting" it is meant that in the absence of other movement-restricting elements, and as far as the bearing produced between bearing surfaces 9 and 52 is concerned, the driver 38 is free to rotate around axis A—A' with respect to the handle 4.

The bolt/restrictor/bearing combination are arranged in a way to restrict the maximum distance between the head 6 and the activator so that when the head 6 is caused to turn with respect to the activator the ramps 12' and 26' as well as 12'' and 26'' are caused to be displaced with respect to each other, respectively, pushing the activator 20 toward the driver 38, which in turn causes the first and the second frictional surfaces 25 and 43, respectively, to firmly engage and lock the driver 38 to the activator 20. The displacement of the pairs of the helical ramps with respect to each other causes locking of the head 6, and therefore the handle 4, with respect to the driver 38 through the activator 20.

In order to better control the direction at which the tool 2 will drive a socket, it is important to provide a first bias means in order to bias the activator 20 with respect to the head 6 in a way to prevent displacement of the doublets of ramps 12 and 26 with respect to each other in one direction, and preferably facilitate the doublets to come in contact in the opposite direction, which causes the first and the second surfaces 25 and 43 to come in contact with each other, and allows movement in one direction but prevents movement in the opposite direction. When the activator 20 is biased against any displacement of the doublets of ramps 12 and 26 with respect to each other, free movement of the driver is allowed in both directions.

In the example of this particular embodiment, two additional elements may be used to achieve this.

One additional element is a selector 60, better shown in FIG. 1*b*, having on one side a knob 62 for allowing an operator to rotate the selector 60, and a short shaft 64 having a diameter commensurate to the diameter of the perforation 7. The short shaft 64 has a thin stalk 66 connected to it in the vicinity of its perimeter away from the knob 62. The thin stalk 66 has a reduced diameter sector 68 at the point where it meets with the short shaft 64. The knob 62 has preferably a visual indicator 70, which is preferably in a diametrically opposite position with respect to the position of the thin stalk 66. The length of the short shaft 64 is preferably substantially equal to the thickness of the head 6.

A second additional element is a bent wire spring 72, better shown in FIG. 1*c*, having a biasing portion 74 and two fastening bends 76, the distance between the bends being equal to the distance between the two small holes 36 of the guide 32.

The rise of each single helical ramp from a low point 23 toward a high point 29, represented by the angle of the respective helix, should be coordinated with the angle 31 and 45, and the coefficient of friction of the frictional surfaces 25 and 43 so that the torque at the handle 4 is smaller than the frictional torque produced by the frictional surfaces 25 and 43, when the tool is in a locking position. Typical values for the helix angle should be in the order of 10 to 25 degrees, for steel surfaces having a cone angle 31 and 45 of about 10 to 20 degrees.

Assembling the tool 2 may be performed in a number of different ways. One of the preferred ways is described below, since it gives better insight to the operation of the tool.

First, the fastening bends 76 of the bent wire spring 72 are snapped in the small holes 36 of the activator 20, in a manner that the biasing portion 74 is positioned on top of the elongated slot 34. Also, the short shaft 64 of the selector 60 is inserted in the perforation 7 of the handle 4, in a manner that the indicator 70 is directed away from the head 6, and the short stalk 66 points toward the head 6. In this position, a small wire spring (not shown) under the knob 62 and supported by the knob 62 snaps temporarily into one of the four indentations 11. Also, in this position, the thin stalk 66 will not interfere with or engage the bent wire spring 72 in further assembling steps, as better shown in FIG. 2*a*, which illustrates the position of the thin stalk 66 with respect to the spring 72. A thin retaining ring (not shown) is then inserted in the reduced diameter sector 68 to secure the selector 60 on the handle 4.

In sequence, the activator 20 is placed on top of the driver 38 so that the second frictional side 42 nests in the first frictional side 24, and so that the first frictional surface 25 rests on the second frictional surface 43.

After the above operation, the head 6 is placed on top of the activator 20, so that the first set of doublets of helical ramps 12 is matched with the second set of doublets of helical ramps 26, one being the mirror image of the other. The orientation of the handle 4 is chosen in a manner that the perforation 7 of the handle 4 is positioned on top of the biasing portion 74 of the bent wire spring 72 and the elongated slot 34 of the guide 32.

Subsequently, the sleeve 50 of the restrictor 46 is passed through the first center bore 16 and the second center bore 30. Finally, the bolt 54 is inserted through the V-shaped bore 48, and threaded on the threaded bore 44, completing the assembling process.

In operation of this embodiment, a socket having a desired size is secured in the socket driving stem 40 of the driver 38. The selector 60 is then turned in one of four positions, which influences the biasing status of the activator 20 with respect to the head 6 of the handle 4.

If the knob 62 is turned in a manner that the thin stalk 66 is directed toward the head 6, the thin stalk 66 does not touch the bent wire spring 72 and no biasing through the spring 72 occurs. The relative positions of the spring 72 and the thin stalk 66 are illustrated in FIG. 2*a*. With the knob 62 in this position, when the socket is engaged on an item to be turned, such as a nut for example, and the operator turns the handle in one or the opposite direction, the activator 20 tends to stay stationary, since it rests on the driver 38, and the first and second frictional surfaces 25 and 43, respectively, are in contact, thus providing adequate friction to oppose movement of the activator 20 with respect to the driver 38. As the handle 4 continues moving, the first set of doublets of helical ramps 12 is displaced with respect to the second set of doublets of helical ramps 26, causing a force to be exerted which pushes the activator 20 away from the head 6, and towards the driver 38. Since the distance between the head 6 and the driver 38 is restrained by the restrictor 46 through the bolt 54 (which is threadably or otherwise connected to the driver 38), the force exerted to the activator 20 results in increased frictional locking of the activator 20 onto the driver 38 through their respective first and second frictional surfaces 25 and 43. The higher the force the operator applies on the handle the higher the pressure applied form one frictional surface to the other, and therefore the higher the frictional locking of the activator 20 to the driver 38. Additionally, at the same time, the doublets of helical ramps 12 and 26 are jammed with respect to each other, thus temporarily locking the head 6 and the handle 4 to the activator 20. The final result of these actions is temporary but secure locking of the handle 4 to the driver 38 through the activator 20. Thus, the operator may turn the item, such as a nut for example, through the socket attached to the driver.

If the operator changes direction of turning the handle, the same sequence of events takes place, and the tool 2 is also locked in this new direction. It is now clear that in the absence of biasing of the activator 20 with respect to the head 6 of the handle 4, results in locking the driver 38 with respect to the handle 4 in both directions. In moving from one locking position to the opposite locking position, there is involved some idle rotational movement of the handle with respect to the driver. However, this is inconsequential for the purposes of this invention, since the idle movement may be substantially eliminated completely by biasing the activator 20 with respect to the head 6 in one or the opposite direction, as it will be detailed hereinbelow.

If the knob 62 is turned in a manner that the thin stalk 66 is directed away from the head 6, the thin stalk 66 stays in the biasing portion 74, thus appending the activator 20 onto the handle 4 through the bent wire spring 72. At this position, the first and second sets of doublets of helical ramps 12 and 26 are aligned with respect to each other. The relative positions of the spring 72 and the thin stalk 66 are illustrated in FIG. 2*b*. With the knob 62 in this position, when the socket is engaged on an item to be turned, such as a nut for example, and the operator turns the handle in one or the opposite direction, the activator 20 follows the handle as being appended from it, provided that the spring 72 is adequately strong to overcome any frictional forces tending to oppose rotational movement of the activator 20 along with the rotational movement of the handle 4. This condition, which circumvents displacement of the 2 sets of doublets of helical ramps 12 and 26 with respect to each other, results in substantially free movement of the handle 4 with respect to the driver 38, and the tool 2 is unlocked in both directions.

If the knob 62 is turned in a manner that the thin stalk 66 is aimed in a direction about 90 degrees different from the directions described in the two previous cases, the activator 20 is biased to rotate somewhat with respect to the handle, so as to cause displacement of the two sets of the doublets of helical ramps with respect to each other, resulting in forcing the activator 20 toward the driver 38 and preliminary engagement of the first and second frictional surfaces 25 and 43. Any attempt of an operator to turn the handle 4 in a direction favoring the biasing forces, fortifies the tendency of the matched single helical ramps 12' and 26" , or 12" and 26" (depending on the direction of turning) to be displaced further with respect to each other, and for the same reasons as described above, it increases the frictional locking of the driver 38 to the activator 20 and in turn to the handle 4. If the operator pulls the handle 4 in a direction against the biasing forces, the sets of the matching singlets of helical ramps tend to realign themselves away from the displacement positions, and free the diver 38 from the activator 20, and in turn from the handle 4, thus allowing free rotational movement of the handle 4 with respect to driver 38. The relative positions of the spring 72 and the thin stalk 66 in this case are illustrated in FIGS. 2*c* and 2*d*. In the case of FIG. 2*c* the activator 20 as been biased in a certain direction with respect to the handle 4, while in the case of FIG. 2*c*, the activator 20 as been biased in the opposite direction with respect to the handle 4.

It may be seen from the above, that biasing of the activator with respect to the handle or base, results in biasing the doublets of the helical ramps. It may also be seen that the toothless rachet or the clutch mechanisms, depending on the way the of each pair of the doublets of the helical ramps are biased, follow a condition selected from the group consisting of locking the base with respect to the driver in one direction, locking the base with respect to the driver in an opposite direction, locking the base with respect to the driver in both directions, maintaining the base unlocked with respect to the driver in both directions, and a combination thereof.

Due to the fact that using a spring, as described above, for biasing of the activator 20 with respect to the handle 4 brings substantially the tool in a locking position (in the direction favoring the biasing forces) no substantial further movement of the handle 4 with respect to the driver 38 is needed to effect locking. According to this invention, a rotation of only a fraction of a degree is usually adequate to effect locking of the biased tool. This is a vast improvement over conventional ratchet mechanisms which typically require a minimum of 15 to 20 degrees of handle rotation in order to operate.

The characteristic of the mechanisms of the present invention to only require almost infinitesimal rotational movement in order to operate, combined with their simplicity, is a unique feature allowing high diversity of applications.

Thus, this mechanism of clutching action, according to this invention, between the activator and the driver, which finally results in locking action of the driver with the handle may take different forms depending on the application it is being used for. The handle portion of the tool may become a base for supporting different structural configurations, and thus take different forms and shapes, having no resemblance to a conventional handle.

For example, the handle 4 may be reduced to just the head 6 portion and become a base for supporting a socket with the back part of the socket pointing away from the head and having a cavity of the type which can accept and engage with a socket driving stem, the socket having A—A' as an axis of symmetry. Such a device may be used in combination with a standard non-rotational socket driver to transform the non-rotational socket driver to a rotational one having the characteristics of a toothless rachet according to this invention. Use of such a device in combination with a torque wrench would present similar advantages. The operation of this embodiment is very similar to the operation of the embodiment described above in detail, with the difference that the socket driving stem of the standard non-rotational socket driver is inserted into the above mentioned cavity in order to form a system operating as the single tool 2 of the previous embodiment.

FIGS. *6a* to *6c* illustrate another embodiment of the instant invention, which lends itself to a less expensive construction. Nevertheless, the mechanism or tool 102 of this embodiment, has elements which perform similar or identical functions as in the case of the previous embodiments. They are merely arranged in simpler units or entities. The toothless ratchet tool 102 comprises in combination an assembly of a handle 104 ending to a head 106. As in the previous embodiments, the head 106 has an upper side 108 and a lower side 110 opposite the upper side 108. The lower side 110 comprises a first set of helical doublets of ramps 112, of the same type as described in FIGS. 4 and 5, hereinabove. This tool also comprises an activator 120, which in turn comprises a second set of helical doublets of ramps 126, commensurate to the first set of the helical doublets of ramps 112 of the lower side 110 of the head 106, thus forming pairs of co-acting doublets of ramps. There is also provided a driver 138, disposed under the activator 120 in a manner to place the activator 120 between the driver 138 and the head 106 of the handle 104. The driver 138 has a second frictional surface 143 commensurate to and adaptable to engage with the first frictional surface 125. The driver 138 has also a driver extension 151, which passes through a washer restrictor 146, and ends to a restrictor holder 153. The restrictor holder 153, may be either a swaged part of the restrictor extension 151, or the head of a screw, similar to the one in the previous embodiments, or any other type of holder to hold the restrictor 146 in place. The restrictor 146 has a middle hole (not shown) for the driver extension 151 to pass through and form the holder 153.

A selector 160, better shown in FIG. *6c*, having different configuration, but similar function as the selector 60 with the spring 72, better shown in FIGS. *1b* to *2d*, is used to bias the ratchet mechanism to be locked in one or the opposite direction. It allows the movement of the first set of helical doublets of ramps 112 with respect to the second second set of helical doublets of ramps 126, while it prevents such movement in the opposite direction. The selector 160 has a knob 162, a short shaft 164, the length of which is substantially equal to the thickness of the head 106, and a semicylindrical extension 167, which is used for said bias. When the selector is turned in a manner, as shown for example in FIG. *6b*, it locks the guide 132 of the activator 120 in one direction with respect to the head 106, so that the two sets of doublets of ramps move simultaneously in the same direction, if an operator turns the handle clockwise, thus preventing the locking of the head 106 with the driver 138. In contrast, when the handle 104 or head 106 is moved by an operator in the opposite direction (anticlockwise), the missing semicylindrical extension 169 allows the two sets of helical doublets of ramps to move with respect to each other, resulting in jamming of the ramps and locking the head 106 to the driver 38. It is seen, therefore, that the operation of this embodiment is substantially the same as the operation of the previous embodiments. It is worth noting that the restrictor holder 153 may be eliminated, if provisions are made to secure the restrictor 136 on to the driver extension 151 by any means well known to the art, such as for example welding, threading, press-fitting, and the like.

In a different embodiment, instead of using one pair of matching frictional surfaces, such as for example 125 and 143 shown in FIG. *6a* of the previous embodiment, one may use a plurality of pairs of such surfaces 525 and 543, as better shown in FIG. *6i*. The driver 538 comprises the stem 540, the driver extension 551, and a plurality of circular protrusions having second frictional surfaces 543, corresponding to a second cone angle 545, as better shown in FIG. *6iii*.

The activator 520 has first frictional surfaces 525, in the form of circular grooves, commensurate to the second frictional surfaces 543. A bottom view of the activator 520 is illustrated schematically in FIG. *6ii*, wherein the circular nature of the first frictional surfaced 525 may be better seen.

Of course, the mechanism may be made such that the protrusions are located on the activator 520, and the grooves on the driver 538, or some protrusions on the activator with commensurate grooves on the driver along with some groves on the activator with commensurate protrusions on the driver. The relative size of the protrusions and grooves may vary widely, and the cone angles may differ as long as the protrusion and groove of each pair of frictional surfaces are commensurate to each other.

The operation of this embodiment is substantially the same as the operation of the previous one. The main difference is that instead of locking one pair of commensurate surfaces, a plurality of such pairs is used in this embodiment.

Figure 7A:
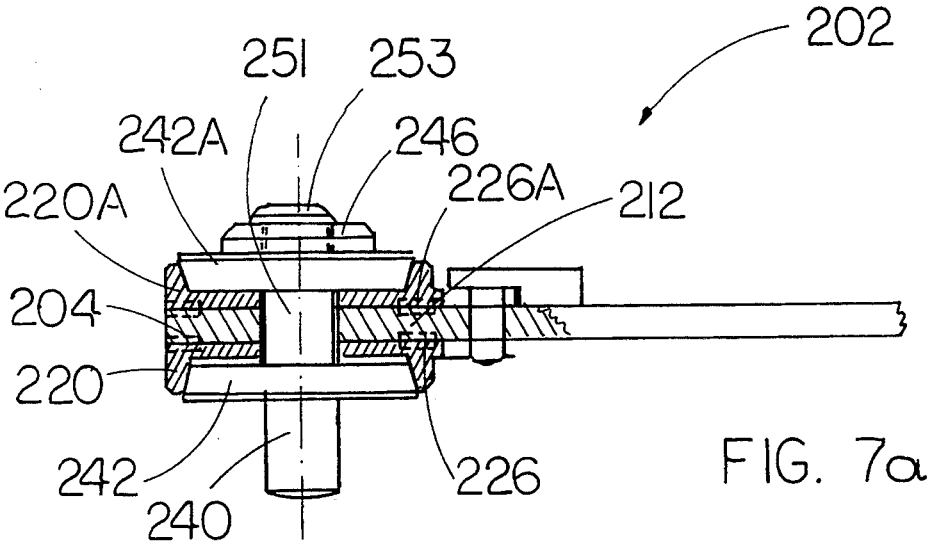
FIG. 7*a* illustrates another embodiment of this invention, wherein two second frictional sides are used instead of one.
Figure 7B:
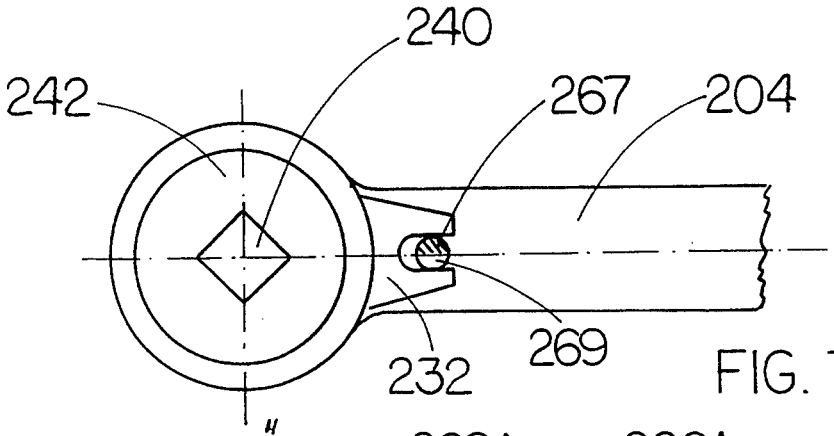
FIG. 7*b* shows the bottom view of the embodiment illustrated in FIG. 7*a*.
Figure 7C:
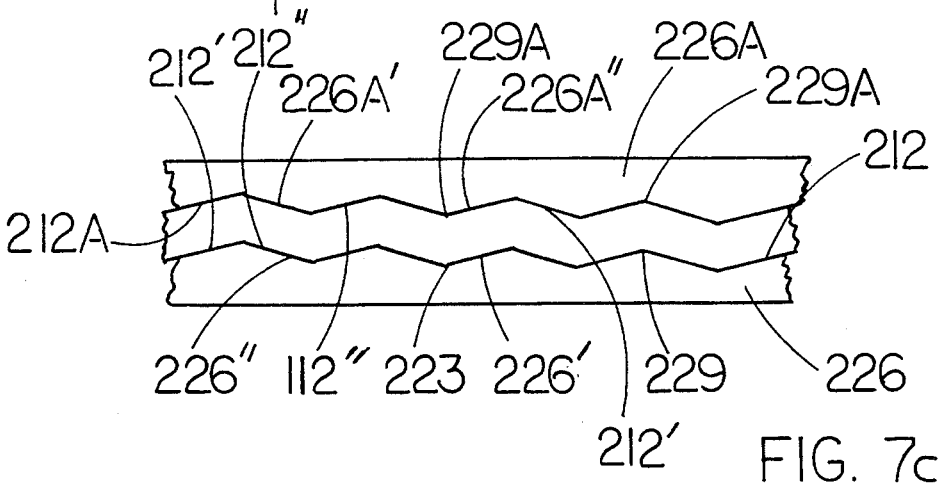
FIG. 7*c* illustrates an unfolded cross section of a two pairs of sets of doublets of ramps, which are used according to the embodiment shown in FIGS. 7*a* and 7*b*.

Still another embodiment of the present invention is depicted in FIGS. 7*a* to 7*c*. The difference of this embodiment from the previous ones is the use of two activators 220 and 220A and two respective second frictional sides 242 and 242A instead of one used in the other embodiments. Both second frictional sides 242 and 242A are connected to the driver 240 in a manner that when the driver 240 turns, both sides 242 and 242A are turning along with it. This may be achieved for example by one (242 for example) being integral part of the driver, and the other (242A for example) having a non-circular center hole fitting into a commensurate cross-section of the driver extension. These and the rest of the elements, represented by numerals differing by 100 from the numerals representing the components of the other embodiments, serve the same functions, and operate in a similar manner. It is important to note, that in this particular case, either one or both the restrictor 246, and the restrictor holder 253 may be omitted if the frictional side 242A is rigidly connected to the driver extension 251. In FIGS. 7*a* to 7*c*, the letter A after each numeral represents parts of the additional second frictional surface 242A and the additional activator 220A. Thus any further discussion regarding the assembly of the different elements of the operation of the mechanism 202 would be redundant.

The clutch mechanisms as described above may further comprise pulsating means pivotally connected to the base 4, 104 or 204 for providing oscillatory motion to the base around the center axis A—A'. The pulsating means could be any oscillation providing means, but preferably they are of pneumatic and/or electromagnetic nature, since these types of power are readily available to tools and other moving mechanisms. Since the smaller the amplitude of the oscillations the simpler the structure of the transducer, for example of an electric to mechanical/oscillatory motion is, the devices of this invention, which require almost infinitesimal movement to operate, are most suitable for changing the oscillatory motion on the base 4 (or 104, or 204) to rotational motion on the driver 38 (or 138 or 238). The oscillatory motion of the base may be characterized by an oscillation angle, which is the angle that the base turns around the axis A—A' in each oscillation. It is important that the angle has an effective value to translate the oscillatory motion of the base to rotational motion on the driver for the tool to be operational. The effective value depends on many factors, some of which are the quality of the tool, the nature and modulus of the materials used, the loads involved, and the like. As aforementioned, in a prototype made according to this invention, a rotation of only 0.28 degree was adequate to effect locking of the handle or base to the driver. Preferably, the oscillatory angle has a value in the range of 0.5–10 degrees. In operation, the oscillatory means cause the base to oscillate back and forth. Depending on the direction of biasing of the activator with respect to the base, one of the two half-oscillations (back or forth) will cause the driver 38 to rotate in the direction favoring the biasing forces, while during the other half oscillation, the driver will remain idle. Thus, as the oscillations continue to take place, the driver 38 (or 138, or 238) will proceed rotating.

In the different embodiments of this invention, the socket driver 140 or 240, for example, may be missing, and the driver extension may have a central perforation, preferably throughout its length of suitable shape to be used as a socket itself. In such a case, no changeable biasing would be necessary, since a nut would be turned one way or the opposite way by the ratchet of this invention, depending on the side of the ratchet used to engage the nut.

Referring back to the ratchet of this invention, which comprises a socket driver, it is important to note the fact that if the socket fits only loosely in the stem of the socket driver, the main advantage of immediate engagement and elimination of backlash according to this invention is reduced. Therefore, an additional mechanism is needed to negate this undesirable effect. Although there are different arrangements in the marketplace by which a loose socket is secured on the socket drive stem, they are completely ineffective in eliminating the backlash.

Applicants have found that by using a second biasing means for biasing the stem of the socket driver with respect to the socket cavity in a manner that when the head is returned to its initial position, it does not cause the stem to follow the same movement, the aforementioned problem is eliminated. Of course, the biasing has to take place in off-center positions of the sides of the stem. It may take place preferably in two positions, which may be located on the same or on different sides of the stem. The location of these positions has to be such that if one position biases the stem in the socket in one direction, the other position biases the stem in the socket in the opposite direction. The biasing arrangement of the second biasing means may be better illustrated by the following examples, which are depicted in FIGS. 8*a* to 9*b*.

Figure 8A:
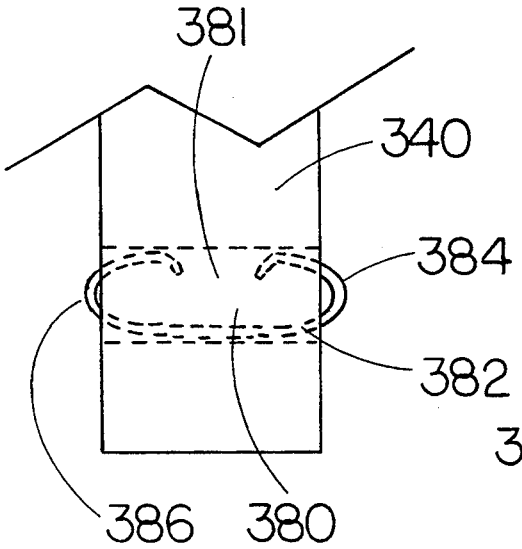
FIG. 8*a* shows a stem having an oblong opening containing a frictional spring in order to eliminate backlash between the stem and the socket.
Figure 8B:
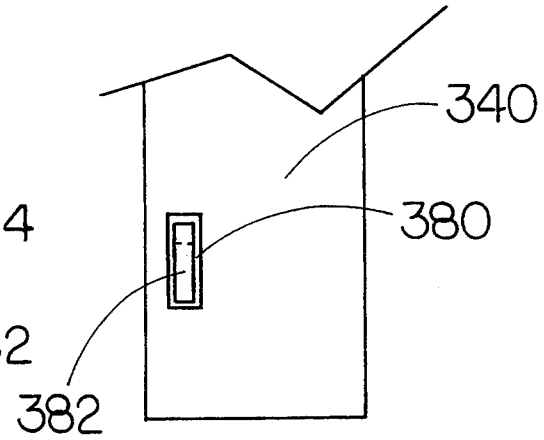
FIG. 8*b* represents a side view of the stem illustrated in FIG. 8*a*.

FIG. 8*a* illustrates a fractional view of a socket driver stem 340, where the positions for biasing in opposite directions are located at respective different sides of the stem. In this embodiment, the stem 340 has an oblong opening 380, containing a frictional spring 382. The frictional spring 382, has a first end 384 and a second end 386, and it snugly nests in the opening 380. At least one or the two ends 384 and 386 should extend outside the oblong opening 380, when no external force pushes one against the other. However, the frictional spring may be forced to slide one way or the other by pushing the respective end. The frictional spring is held in place from sliding freely by frictional forces developed by the outside surfaces of the frictional spring and the inside surfaces of the opening 380. The cross-section of the frictional spring 340 may be round, but it is preferably of a thin rectangular type. A side-view of the stem 340 is shown in FIG. 8*b*, along with the opening 380 and the spring 382.

Figure 8C:
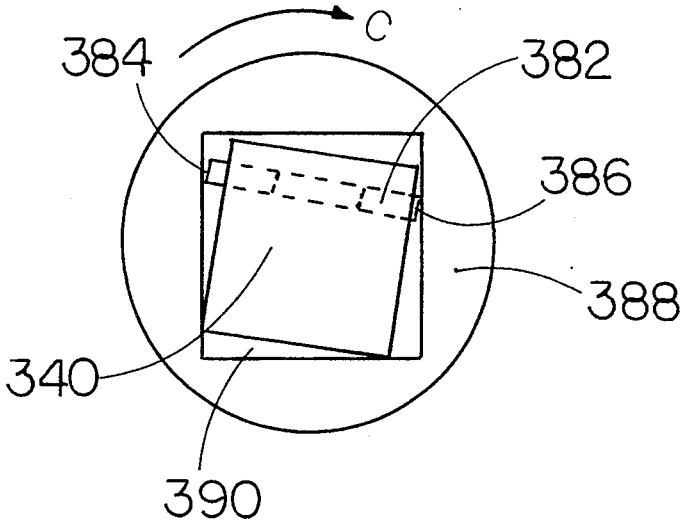
FIG. 8*c* illustrates a cross section of an undersized stem, in the multi-sided cavity of a socket.

FIG. 8*c* is a cross-sectional view of stem 340. inserted in a socket 388, the socket having a multi-sided cavity (square, in this case) 390. The cavity 390 has been drawn in FIG. 8*c* larger than what the specifications of a standard cavity of a socket would permit for the size of the stem 340 of this example, just for better illustration purposes. The stem 382 is shown in FIG. 8*c* in a clock-wise biased position, in a direction indicated by arrow C.

In operation, the stem 340 of a rachet tool (not shown) is inserted by the operator in the multi-sided cavity 390 of the socket 388, without taking any precaution regarding biasing or attempting to position the stem 340 in any particular manner with respect to the cavity 390. Depending on how larger is the cross-sectional size of the cavity of the socket as compared to the cross-sectional size of the stem, one or both ends 384 and 386 of the frictional spring 382 may be disposed or forced to be disposed inside or outside the oblong opening 380 of the stem 382. The ends of the frictional spring 382 are adaptable to bend adequately, mainly due to the open portion 381 of the frictional spring 382, so that even if the size of the stem matches exactly the size of the cavity, the whole frictional spring is forced to fit within the opening 380. The operator has then at least two choices:

According to one choice, the operator first selects the turning direction of the socket, by using for example a selector, such as for example selector 60, better shown in FIG. 1*b*. If this direction is for example the direction shown by arrow C (FIG. 8*c*), the operator holds the socket 388 and turns the handle of the tool (not shown) in the same direction shown by arrow C. This forces the frictional spring 382 to slide, despite considerable frictional resistance, within the oblong opening 380, which in sequence forces the stem 340 to take and maintain the biased position shown in FIG. 8*c*. The other end of the socket (not shown) is then engaged to a respective nut (not shown). Since the frictional spring 382 holds the stem 340 in the biased position within the cavity with considerable force due to the frictional resistance of the frictional spring 382 within the opening 380, pulling the handle (not shown) in the backward direction, does not disturb the biased position between the stem 340 and the cavity 390. Thus, by going again to the forward movement of the handle which turns stem 340 in the direction of the arrow C, no drag or backlash occurs. Thus, backlash is eliminated any following cycles of this operation.

A different choice the operator has is to start proceeding as in the case of the previous choice, but he or she omits the step of holding the socket 388 and turning the handle of the tool (not shown) in any direction for biasing the position of the stem 380 with respect to the cavity 390. Therefore, most probably, the stem 340 does not find itself positioned in the biased position shown in FIG. 8*c*. Thereafter, the operator uses the rachet in a normal manner, well known to any person of ordinary skill in the art. The operator, for example engages the other end of the socket (not shown) with a nut for example to be tightened or untightened. In sequence, the operator turns the stem 340 in a desired direction, such as for example the direction of arrow C (FIG. 8*c*), with the help of a respective handle, such as handle 4 for example shown in FIG. 3. After a first forward stroke of the handle to turn the socket 388 through stem 340, the stem 340 will assume the biased position shown in FIG. 8*a*. Since the frictional spring 382 holds the stem 340 in the biased position within the cavity 390 with considerable force due to the frictional resistance of the frictional spring 382 within the opening 380, pulling the handle (not shown) in a backward direction, does not disturb the biased position between the stem 340 and the cavity 390. Thus, by going again to the forward movement of the handle, which turns stem 340 in the direction of the arrow C, no drag or backlash occurs. Thus, backlash is eliminated at any following cycles of the operation.

Figure 6A:
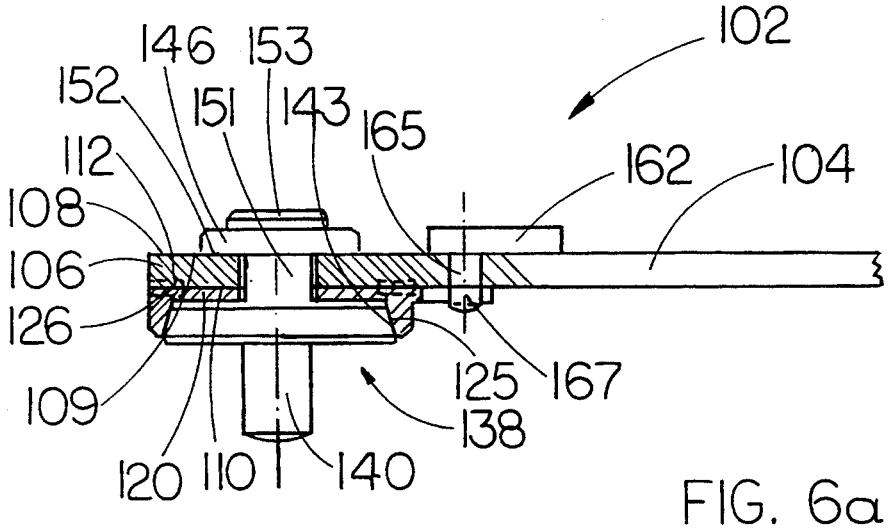
FIG. 6*a* illustrates another embodiment of this invention, wherein a selector lacking a frictional spring is used for biasing the locking mechanism.
Figure 6B:
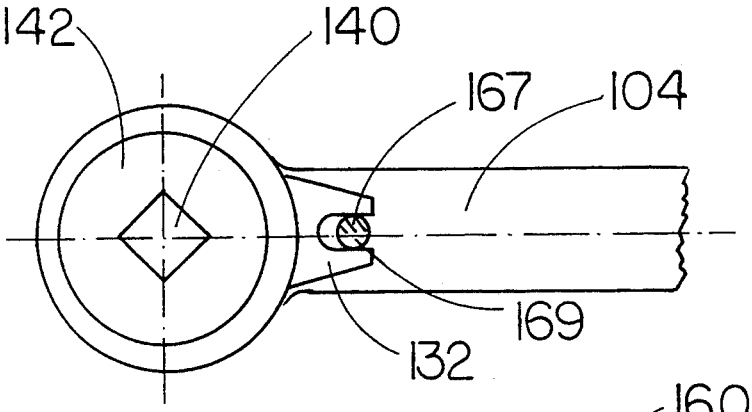
FIG. 6*b* shows the bottom view of the embodiment illustrated in FIG. 6*a*.
Figure 6C:
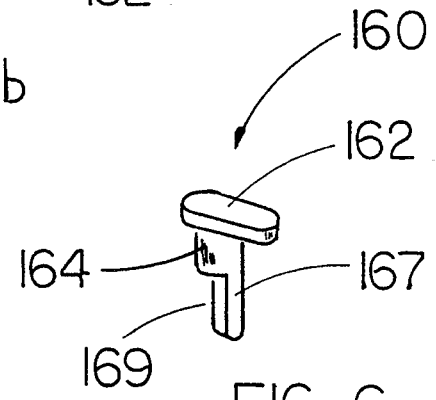
FIG. 6*c* illustrates a perspective view of the selector used in the embodiment FIGS. 6*a* and 6*b*.
Figure 6I:
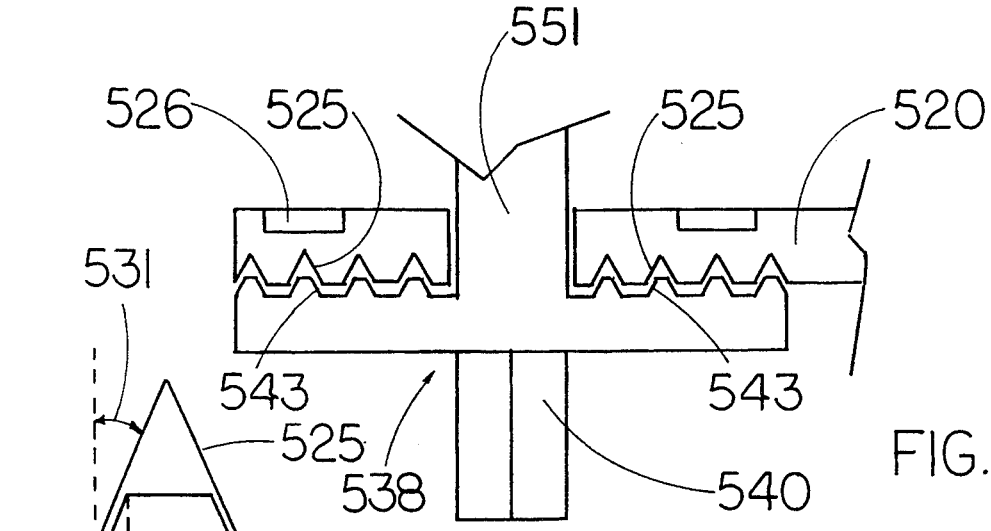
FIG. 6*i* is a fragmental cross-sectional view of a different embodiment of the present invention, wherein a plurality of frictional surfaces are utilized.
Figure 6I:
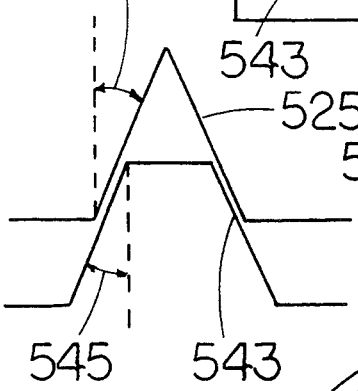
Figure 6I:
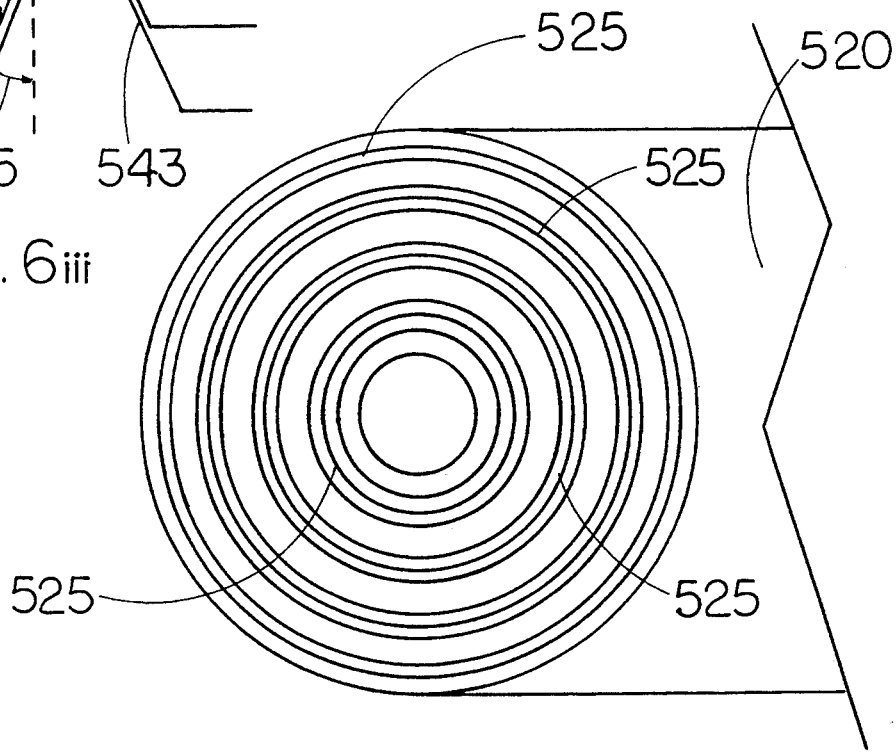
Figure 9A:
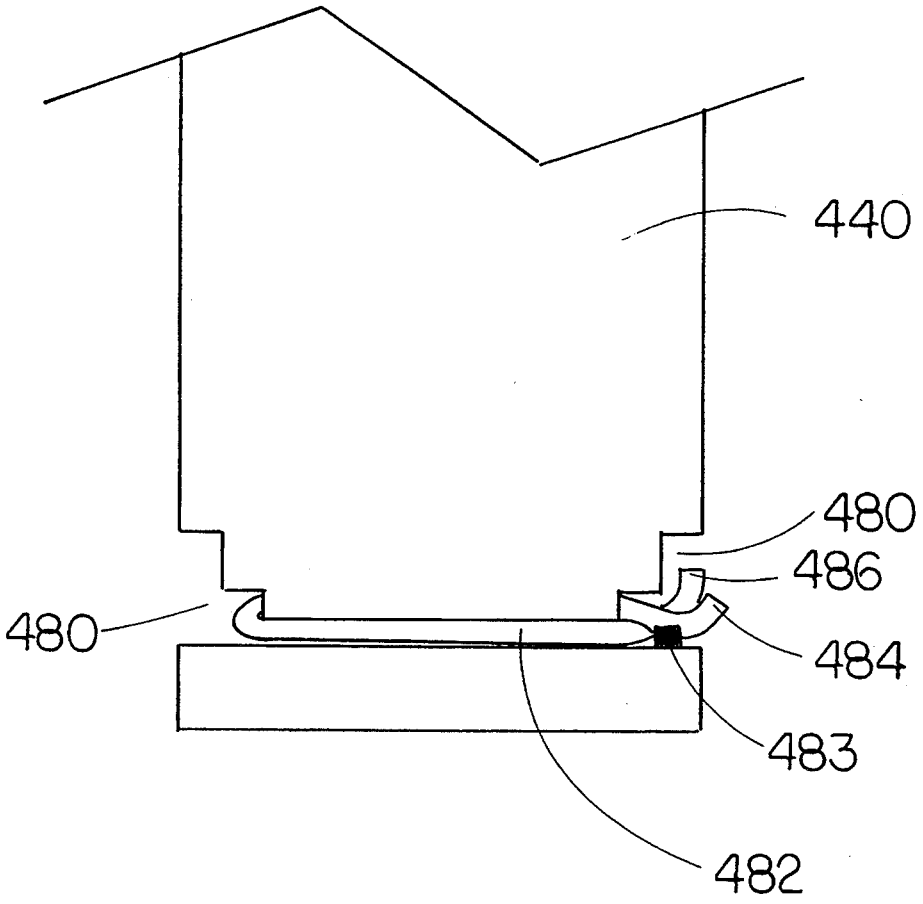
FIGS. 9*a* and 9*b* illustrate another embodiment, which utilizes a rounded cavity nesting a frictional spring for eliminating backlash between stem and socket.
Figure 9B:
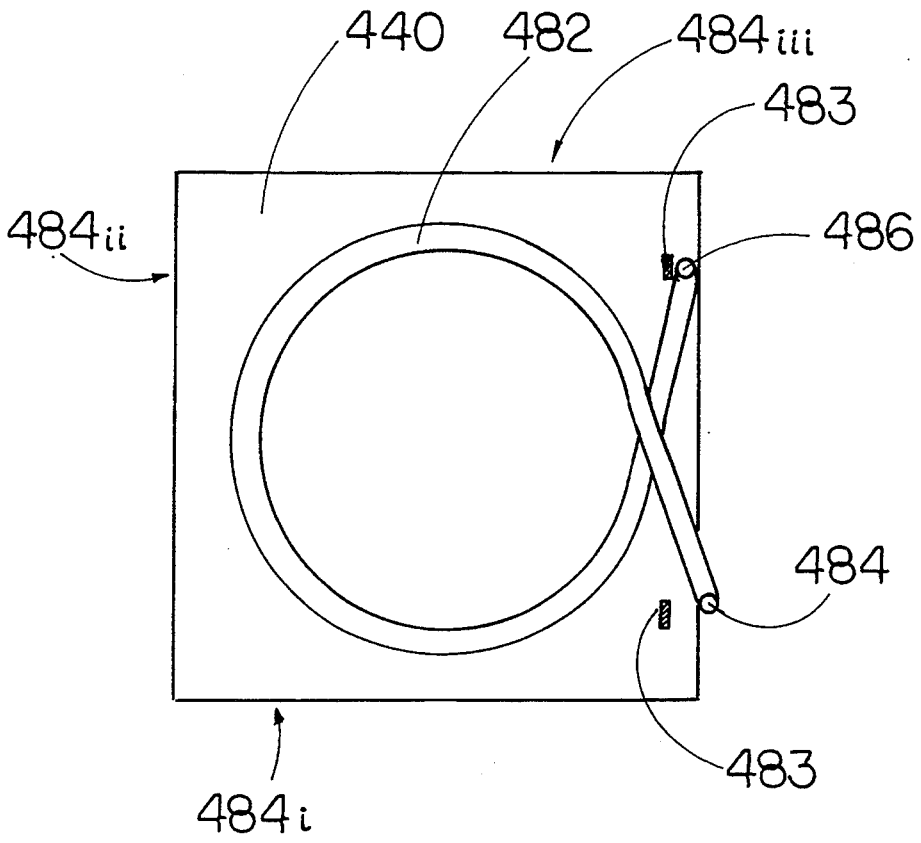

Another embodiment is illustrated in FIGS. 9*a* and 9*b*, where the two positions for biasing in opposite directions are located at one side of the stem. In this embodiment, the stem 440 has a round groove 480, around which, there is snugly fitted a frictional spring 482, for providing adequately high frictional forces between the groove and the frictional spring. These frictional forces, as well as the respective frictional forces of the previous embodiment, have to be higher than the forces needed to turn idly the handle (for example 104 in FIG. 6*a*), with regard to the stem (for example 40 in FIG. 6*a*, corresponding to stem 440 of the present embodiment). However, forces reasonably higher than the ones needed to turn idly the handle are adequate to move the frictionally engaged frictional spring and provide appropriate biasing.

The frictional spring 482 has two ends 484 and 486, both of which have an upward bend as better shown in FIG. 9*a*, for easy insertion into a socket cavity (not shown). The frictional spring 480 may have one or more turns, it may be round in cross-section, or it may have other cross sectional shapes. The groove 480 is preferably circular, or it may also be polygonal or have any other shape, depending on the application.

Two stops 483 within the cavity, restrict the free movement of the ends 484 and 486, in a manner that the frictional spring 482 cannot assume any undesirable position within the grove, and in a manner that no end may extend excessively outside the perimeter of the stem 480 and prevent easy insertion of the stem in the cavity of a socket. The frictional spring 482 may have more than one turn, so that if the end 486 remains in the vicinity of the position 486 shown in FIG. 9*b*, the end 484 may be located in the vicinity 484*i* or 484*ii*, or 484*iii*. An important consideration for each of the ends 484 and 486 is not to be at the center of any side, and to be located at such half sides of the stem so that if one end biases the stem with respect to the cavity of the socket toward one direction, the other end biases the stem toward the opposite direction.

The operation of this embodiment is substantially the same as the operation of the previous embodiment. After the stem is inserted into the cavity of a socket for tightening ot untightening a nut, for example, the frictional spring 482 is forced to overcome the friction and rotate one way or the other (provided that the socket is undersized) after the operator performs the first stroke of the handle of the tool, and it biases the stem with respect to the socket so that no backlash takes place in further strokes of the handle, as well explained hereinabove.

Figure 10A:
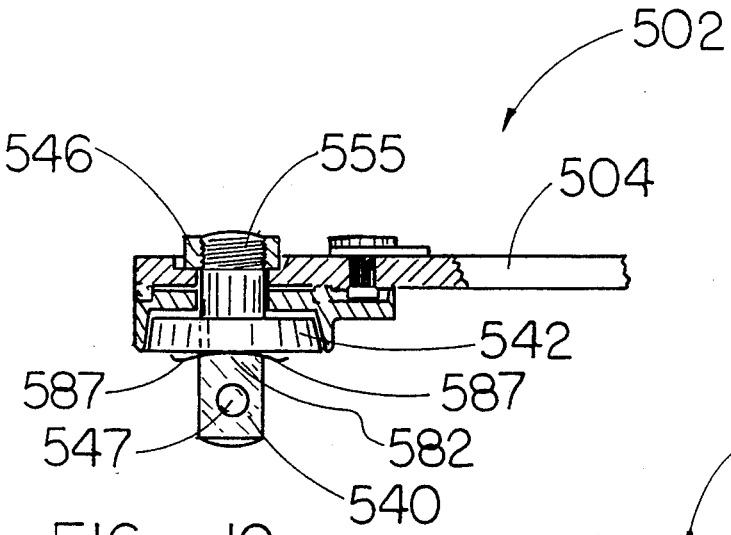
FIGS. 10*a* to 10*c* depict still another embodiment of the present invention, wherein a bent frictional spring is used as second biasing means for eliminating backlash between stem and socket.
Figure 10C:
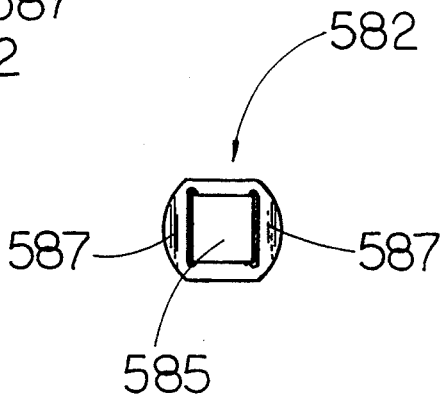
Figure 10B:
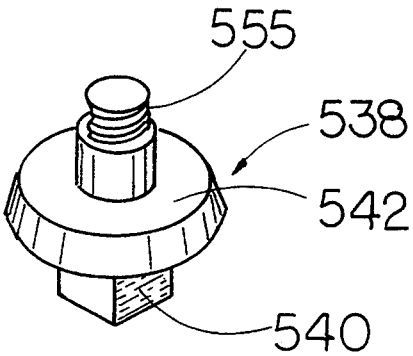

In a still different embodiment of the present invention, better illustrated in FIGS. 10*a* to 10*b*, there is provided a tool 502, similar to the tools described in the previous embodiments, comprising a handle 504, a driver 538 having a socket driving stem 540, a conical frictional side 542, and a threaded portion 555 at the opposite side of the driver 540. The threaded portion 555 is used to secure a restrictor 546, which is in the form of a nut in this embodiment. Different means, such as interfering threads, locking screws or pins, adhesive compounds, and the like (not shown), as also described hereinabove, may be used to secure the nut 546 on the threaded portion 555 of the driver 538.

The stem 540 comprises means to secure a socket (not shown) on the stem, which means may be in the form of a spring loaded ball 547, very well known to the art, and very commonly used for this purpose. The tool 502 also comprises a frictional spring 582 which has a hole 585, commensurate to the cross-section of stem 540, and downwardly bent sides 587, as better shown in FIG. 10*c*. The spring 582 is located at an upper portion of stem 540 and it preferably in contact with the conical side 542. It is connected to the stem slidably or otherwise, in a manner that when the stem turns the spring turns also with minimal slack.

In operation, the stem 540 is pushed into the cavity of a socket (not shown), forcefully enough to push the downwardly bent sides 587 of the spring 582 toward the side 542 of the driver 538, thus causing frictional engagement between the spring 582 and the socket (not shown). The ball 547 has adequate strength to hold the socket (not shown) in frictional engagement with the spring 582, even after the operator has inserted the stem into the socket as described hereinabove. In case the stem 540 is undersized as compared to the cavity of the socket, as well illustrated in previous embodiments, and the operator turns the handle 504 of the tool 502 in one direction (for threading or unthreading a nut, for example), the stem turns until its corners engage with the sides of the rachet cavity, as illustrated for example in the embodiment of FIG. 8*c*. At the same time, the spring 582, due to its engagement with the stem, it follows the stem 540. The spring also overcomes the frictional engagement with the socket (not shown), due to the high forces applied when the tool is in its locked mode. When the operator returns the handle to its original place, the tool is in its unlocked mode, the forces applied on the driver 538 are minimal, and thus the frictional engagement forces between the stem and the socket through the frictional spring 582 prevail, and the stem remains in a biased position, wherein the corners of the stem remain in contact with the sides of the cavity of the socket (as shown for example in FIG. 8*c*) so that from this point on, no backlash between the stem and the socket takes place.

In conclusion, the particular embodiments discussed above are only given as examples and should not be considered as limiting factors to the scope of the present invention. Although certain combinations of preferred parameters were given as examples, any other combination of the cited parameters lies within the realm of this invention, depending on the application and intended end-use of this invention.

It should be noted that numerals differing by a multiple of 100, have been utilized to describe the different embodiments of this invention, and they represent substantially the same elements, intended in general to perform substantially the same functions, and therefore, they should be used as such for a better understanding of the different aspects of the instant invention.

What is claimed is:

1. A toothless ratchet tool comprising in combination an assembly of:

a handle ending to a head, the head having an upper side and a lower side opposite the upper side, the lower side comprising a first set of helical doublets of ramps, each doublet of ramps comprising two single ramps of opposite helical inclination, the doublets of ramps disposed around a center axis, the center axis passing through a central point of the head, and being perpendicular to the lower and upper sides;

an activator disposed toward the lower side of the head and pivoted around the center axis, the activator having a doublet side and a first frictional side opposite the doublet side, the first frictional side comprising at least one first frictional surface the doublet side comprising a second set of helical doublets of ramps commensurate to the first set of the helical doublets of ramps of the lower side of the head, thus forming pairs of co-acting doublets of ramps;

a driver being turnable around the center axis and disposed under the activator in a manner to place the activator between the driver and the head of the handle, the driver having a socket driving side and a second frictional side commensurate to and adaptable to engage with the first frictional side through at least one second frictional surface; and means for rotatably connecting the driver and the head of the handle, and at such distance from each other, that when the doublets of helical ramps of each pair are caused to be displaced with respect to each other, the activator is pushed toward the driver causing the first and the second frictional surfaces to firmly engage and lock the driver in one direction with respect to the handle.

2. A toothless ratchet tool as defined in claim 1, further comprising first biasing means for biasing the doublets of helical ramps of each pair in a position causing the tool to follow a condition selected from the group consisting of locking the handle with respect to the driver in one direction, locking the handle with respect to the driver in an opposite direction, locking the handle with respect to the driver in both directions, maintaining the handle unlocked with respect to the driver in both directions, and a combination thereof.

3. A toothless ratchet tool as defined in claim 1, wherein the doublets of helical ramps are equidistantly disposed from the center axis and also equidistantly disposed from each other.

4. A toothless ratchet tool as defined in claim 1, wherein the first frictional surface comprises a configuration corresponding to at least part of the inside surface of a cone, and the second frictional surface comprises a configuration corresponding to at least part of the outside surface of a cone.

5. A toothless ratchet tool as defined in claim 1, wherein the first frictional surface and the second frictional surface exhibit a cone angle in the range of 10–40 degrees.

6. A toothless ratchet tool as defined in claim 1, wherein the helical angle has a value of 10–25 degrees.

7. A toothless ratchet tool as defined in claim 1, wherein the stem comprises second biasing means for biasing the position the stem with respect to the socket in such a manner as to eliminate backlash of the head, regardless of the direction in which the head is locked with respect to the driver.

8. A clutch mechanism comprising in combination an assembly of:

a base having a head, the head having an upper side and a lower side opposite the upper side, the lower side comprising a first set of helical doublets of ramps, each doublet of ramps comprising two single ramps of opposite helical inclination, the doublets of ramps disposed around a center axis, the center axis passing through a central point of the head, and being perpendicular to the lower and upper sides;

an activator disposed toward the lower side of the head and pivoted around the center axis, the activator having a doublet side and a first frictional side opposite the doublet side, the first frictional side comprising at least one first frictional surface;

the doublet side comprising a second set of helical doublets of ramps commensurate to the first set of the helical doublets of ramps of the lower side of the head, thus forming pairs of co-acting doublets of ramps;

a driver being turnable around the center axis and disposed under the activator in a manner to place the activator between the driver and the head of the handle, the driver having a socket driving side and a second frictional side commensurate to and adaptable to engage with the first frictional side through at least one second frictional surface; and means for rotatably connecting the driver and the head of the handle, and at such distance from each other, that when the doublets of helical ramps of each pair are caused to be displaced with respect to each other, the activator is pushed toward the driver causing the first and the second frictional surfaces to firmly engage and lock the driver in one direction with respect to the base.

9. A clutch mechanism as defined in claim 8, further comprising first biasing means for biasing the doublets of helical ramps of each pair in a position causing the mechanism to follow a condition selected from the group consisting of locking the base with respect to the driver in one direction, locking the base with respect to the driver in an opposite direction, locking the base with respect to the driver in both directions, maintaining the base unlocked with respect to the driver in both directions, and a combination thereof.

10. A clutch mechanism as defined in claim 8, wherein the doublets of helical ramps are equidistantly disposed from the center axis and also equidistantly disposed from each other.

11. A clutch mechanism as defined in claim 8, wherein the first frictional surface comprises a configuration corresponding to at least part of the inside surface of a cone, and the second frictional surface comprises a configuration corresponding to at least part of the outside surface of a cone.

12. A clutch mechanism as defined in claim 8, wherein the first frictional surface and the second frictional surface exhibit a cone angle in the range of 10–40 degrees.

13. A clutch mechanism as defined in claim 8, wherein the helical angles have a value of 10–25 degrees.

14. A clutch mechanism as defined in claim 8, further comprising pulsating means pivotally connected to the base for providing oscillatory motion to the base, the oscillatory motion characterized by an oscillation angle having an effective value to translate the oscillatory motion of the base to rotational motion on the driver.

15. A clutch mechanism as defined in claim 8, further comprising a socket supported on the base, the socket having a cavity of the type which can accept and engage with a socket driving stem, the socket having the center axis as an axis of symmetry.

16. A clutch mechanism as defined in claim 8, wherein the stem comprises second biasing means for biasing the position the stem with respect to the socket in such a manner as to eliminate backlash of the base, regardless of the direction in which the head is locked with respect to the driver.

* * * * *